United States Patent [19]

Sosa

[11] 4,449,121

[45] May 15, 1984

[54] JALOUSIE WITH INTEGRAL ALARM CIRCUIT

[76] Inventor: Jesus M. Sosa, Interamericana 773 University Gardens, Rio Piedras, P.R. 00927

[21] Appl. No.: 319,936

[22] Filed: Nov. 10, 1981

[51] Int. Cl.[3] ..... G08B 13/02

[52] U.S. Cl. ..... 340/550; 200/61.93; 340/665

[58] Field of Search ..... 340/550, 665; 200/61.93

[56] References Cited

U.S. PATENT DOCUMENTS

| | | | |
|---|---|---|---|
| 1,027,679 | 5/1912 | Williams et al. | 340/550 |
| 1,054,993 | 3/1913 | Simon . | |
| 1,575,343 | 3/1926 | Keller et al. | 200/61.93 |
| 2,293,609 | 8/1942 | Livingston . | |
| 2,374,139 | 4/1945 | Schriner | 200/61.93 |
| 3,087,145 | 4/1963 | Fruh . | |
| 3,460,289 | 8/1969 | Toth . | |
| 3,993,988 | 11/1976 | Walter . | |
| 4,160,972 | 7/1979 | La Mell et al. . | |

*Primary Examiner*—Glen R. Swann, III
*Attorney, Agent, or Firm*—Karl L. Spivak

[57] ABSTRACT

Alarm circuit wiring is completely enclosed within a jalousie-type window and includes positive and negative terminals connected respectively to the louver blades and to the shafts which rotate the blades between open and closed positions. An insulating air space is provided between each blade and its center shaft to prevent normally any flow of current therebetween. Any attempt to force the louver blades of the jalousie open will result in the completion of the electrical circuit by causing the blade to deform through the air space so that contact with the center shaft is made. The switch contacts of the circuit consist of a rectangular tube provided along one edge of each louver blade, and a rectangular center shaft housed within the tube, the rotation of which by a conventional turning mechanism causes the blades to open and close. Under normal operating conditions, electrical contact between the two switch points is prevented by insulating nylon separators located at the ends of each blade and interposed between the tube and the shaft. When any of the blades is forced open, the torque applied to the blade will deform the blade and cause contact between the blade tube and its associated center shaft to thereby complete the alarm circuit and cause the burglar alarm device to sound.

24 Claims, 8 Drawing Figures

FIG. 1
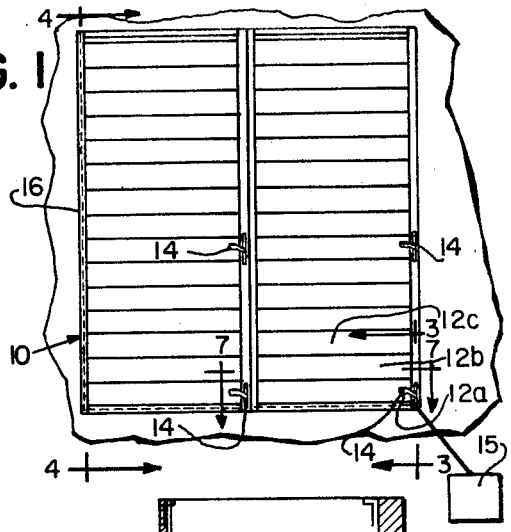
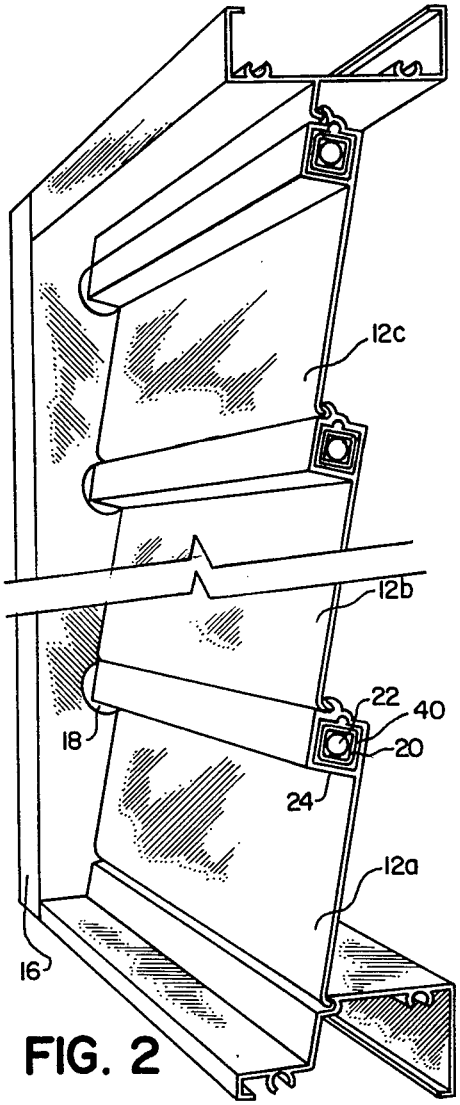
FIG. 2
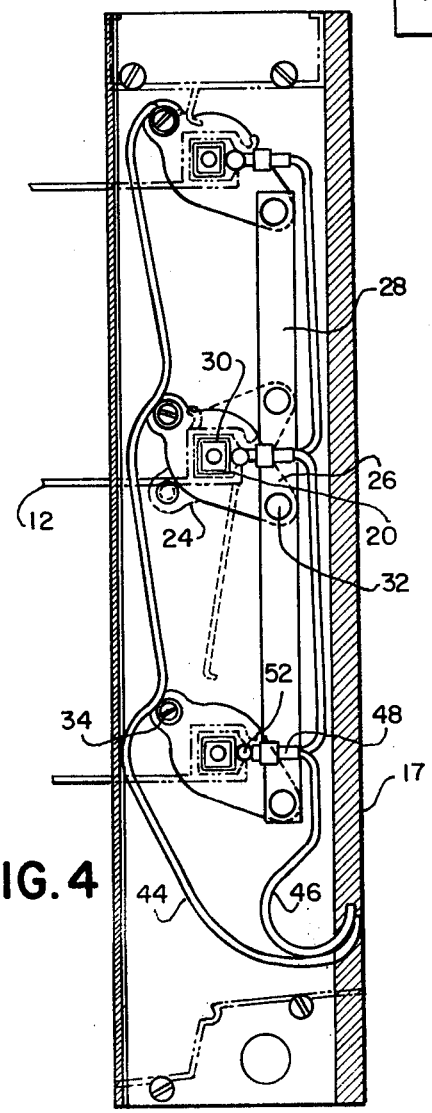
FIG. 4

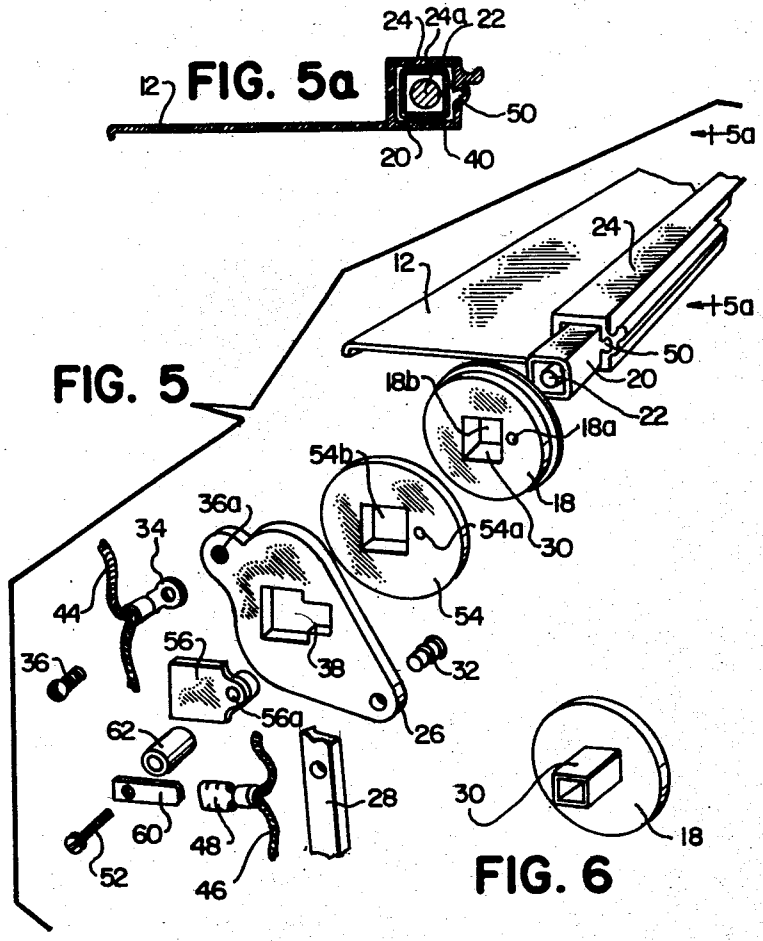
FIG. 5
FIG. 5a
FIG. 6
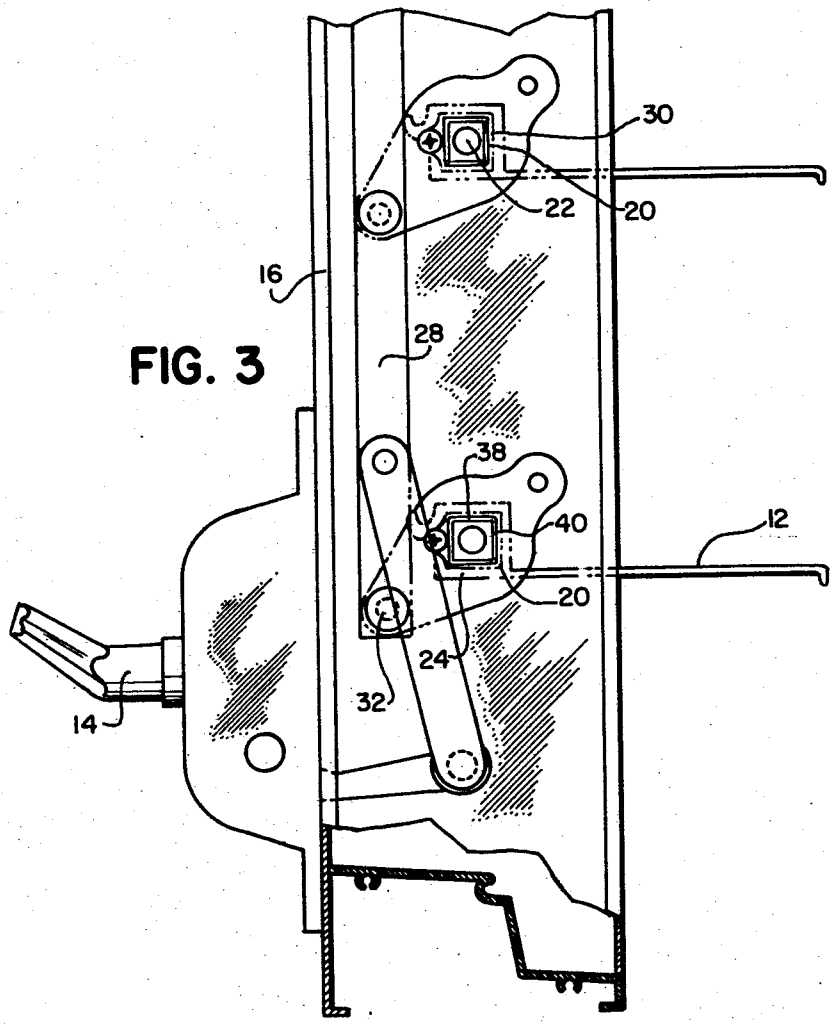
FIG. 3

JALOUSIE WITH INTEGRAL ALARM CIRCUIT

BACKGROUND OF THE INVENTION

The present invention relates generally to the field of window alarm systems, and more particularly is directed to an improvement in jalousie type windows whereby an integral burglar detection device is incorporated.

Jalousie type windows are especially popular in tropical countries because the lower design facilitates easy adjustment to permit entry of the maximum amount of fresh air by exposing substantially the entire window opening in a controlled manner. However, in areas where crime is a fact of life, jalousies create security problems because of the nature of their construction. Accordingly, such windows are frequently combined with iron grills, burglar alarms, or both, in attempts to protect the house and its contents from unauthorized intruders.

The prior art includes numerous window designs which are specially adapted to trigger alarms when tampered with, but few are suitable for use with jalousie type windows. Of the known prior art window and alarm combination designs, applicant knows of no alarm system that can protect the premises both when the blades are open and when they are closed. One intrusion detector apparatus is disclosed in U.S. Pat. No. 3,993,988, issued to Walter, which patent contains a description of the prior art and which is incorporated herein by reference.

SUMMARY OF THE INVENTION

The present invention relates generally to the field of protected jalousie type window constructions, and more particularly, is directed to a novel, integral, electrical alarm and jalousie window design wherein the alarm components are completely secured within the construction members.

The jalousie security window of the present application closely resembles conventional jalousies both in appearance and in operation. A crank is employed to move an operating bar within window jamb to pivotally raise and lower the jalousie blades. As in conventional jalousie type windows, an operating bar is vertically moved by an handle and is connected to a blade-affixed lever arm or crank. Vertical reciprocation of the operating bar by rotating the handle in either a clockwise or counterclockwise direction causes the lever arms to simultaneously rotate about their respective axes to, thereby rotate all of the louver blades in unison.

An electrical alarm circuit is incorporated in the blade design wherein one of the the contacts for the electrical circuit comprises a conductive hollow shaft. The conductive shaft passes through, and is insulated from a tubular portion of the blade to normally maintain the alarm circuit in an open, or non-energized condition. The other side of the alarm circuit terminates at the jalousie blade. Contact between the conductive shaft and blade tube is ordinarily prevented by non-conductive pivot bearings or spacers positioned on the ends of each blade. The pivot bearings include an insulating nylon or other non-conductive contact separator which snugly fits within the end of each blade tube. The contact separators surround end portions of each conductive center shaft, thereby suspending and insulating the center shaft within the blade tube to normally prevent the shaft and tube from contacting. The insulation of each blade tube from its conductive center shaft is maintained under all periods of normal use, whether the jalousie blades are opened or closed. However, should an intruder attempt to force his way through the jalousie-alarm protected window, either when open or closed, by prying or otherwise distorting one or more of the conductive blades, the integrity of the insulating air space between a blade and its conductive shaft will be destroyed, thereby causing the parts to function as a switch to activate the alarm circuit.

It is therefore an object of the present invention to provide an integral alarm with a jalousie type window which is capable of functioning regardless of the position of the jalousie louver blades.

It is another object of the present invention to provide a novel jalousie with integral alarm circuit wherein all of the alarm system components are hidden within the window construction to prevent inactivation of the alarm by a would-be intruder.

It is another object of the present invention to provide a novel jalousie type window construction with an integral alarm system wherein all of the jalousie blades are wired in parallel to situate alarm triggering means across the entire height and breadth of the window opening.

It is another object of the invention to provide an integral alarm system in a jalousie window in a manner to eliminate the need for extraneous wiring or exposed alarm components.

It is another object of the present invention to provide a novel jalousie with integral alarm circuit that is simple in design, inexpensive in manufacture and trouble free when in use.

Other objects and a fuller understanding of the invention will be had by referring to the following description and claims of a preferred embodiment, taken in conjunction with the accompanying drawings, wherein like reference characters refer to similar parts throughout the several views and in which:

BRIEF DESCRIPTION OF THE DRAWINGS

FIG. 1 is a side elevational view of the jalousie window of the present invention looking from inside the structure in which the jalousie is installed.

FIG. 2 is an enlarged, partial, perspective view of the jalousie window of the present invention, showing the blades in closed position.

FIG. 3 is an enlarged, partial, side elevational view, looking from line 3—3 on FIG. 1, in the direction of the arrows.

FIG. 4 is an enlarged, partial side elevational view looking from line 4—4 on FIG. 1, in the direction of the arrows.

FIG. 5 is an enlarged, exploded, perspective view of the component contact parts of the jalousie alarm of the present invention.

FIG. 5*a* is an enlarged cross-sectional view of the louver blade tube and center shaft, taken along line 5*a*—5*a* on FIG. 5.

FIG. 6 is an enlarged, perspective view of a pivot bearing viewed from the reverse side of that shown in FIG. 5.

DESCRIPTION OF THE PREFERRED EMBODIMENT OF THE INVENTION

Figure 7:
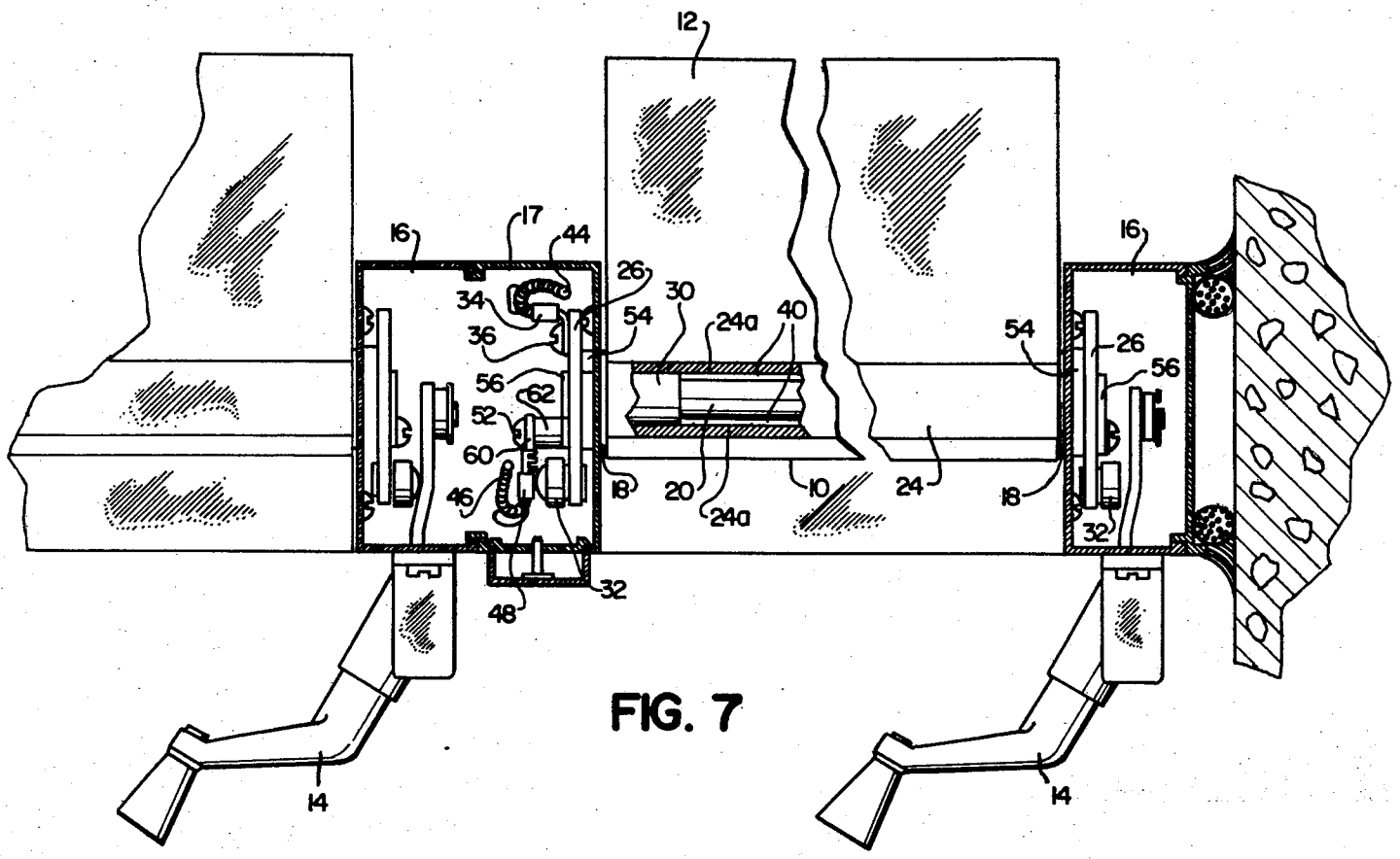
FIG. 7 is an enlarged, partial, cross sectional view taken along line 7—7 on FIG. 1 partially broken away to disclose interior construction details.

Although specific terms are used in the following description for the sake of clarity, these terms are intended to refer only to the particular structure of the invention selected for illustration in the drawings and are not intended to define or limit the scope of the invention.

Referring now to the drawings, there is shown in FIG. 1 applicant's jalousie type window 10, which is installed within a window opening in known manner. The jalousie 10 comprises a plurality of louver blades 12 which blades are horizontally oriented and are illustrated in closed position. A plurality of handles 14 are provided in the usual manner for opening and closing respective banks of blades 12. The dotted lines represent the jamb enclosed wiring which is attached to an alarm system 15, such as a burgler alarm, to actuate a warning signal in the event that the alarm circuit is activated, as hereinafter more fully set forth.

In FIG. 2, the appearance of the closed jalousie louvers from outside of the building is shown. In this orientation, only the blades 12 and the nylon pivot bearings 18 are visible. The entire alarm system is completely protected from tampering and even the existence of such an alarm system can not be determined from without the building. The pivot bearings 18 are fabricated of non-conductive material and are located next to the jalousie jambs 16, 17 (FIG. 7). The bearings 18 cradle the rectangular center shaft 20, insulate the shaft from the blades 12 and facilitate rotation relative to the jalousie jambs 16, 17. The center shaft 20 is preferably fabricated of steel for its combined properties of strength and electrical conductivity. As additionally shown in FIG. 5*a*, the pivot bearings 18 space each steel center shaft 20 within its associated blade tube 24 to define a circumferential insulating space 40 surrounding the center shaft 20. The space 40 functions to maintain the alarm 15 inactive under normal conditions.

Still referring to FIG. 2, each louver blade comprises a hollow tube 24 and a flat blade body 12*a*, 12*b*, 12*c* of integral construction which preferably is formed by extrusion. Each blade body 12*a*, 12*b*, 12*c* and its associated tube 24 is preferably fabricated of aluminum, but the tube may be formed of any other suitable electrically conductive material. It is not necessary that the tube 24 and the blade body 12*a*, 12*b*, 12*c* be formed of the same material. For example, glass blade bodies may be employed if a transparent jalousie is desired. In such construction, the glass blade bodies should be firmly affixed to an electrically conductive tube 24 in known manner. In FIG. 2, there is also illustrated an optional cold rolled round steel bar 22 disposed loosely within the steel center shaft 20. Should an intruder attempt to cut through one of the tubes 24 of a louver blade, the bar 22 will be caused to rotate by action of the saw, thereby preventing the bar, and consequently the louver, from being cut.

As illustrated in FIGS. 3 and 4, a conventional operator, including a handle 14, functions in known manner to raise or lower the operating bar 28, thereby raising and lowering one end of the pivotally connected lever arms or cranks 26. A shoulder rivet 32 is employed to pivotally interconnect the operating bar 28 and each lever arm 26 to effect simultaneous rotation for louver opening and closing. The left and right ends of each center shaft 20 are positioned within rectangular openings 38 in the left and right lever arms 26 to cause rotation of the louver 12 when the lever arms are rotated.

As illustrated, each vertically spaced center shaft 20 is simultaneously rotated by the plurality of lever arms 26. It is noteworthy that a nylon pivot bearing 18 is provided at each interconnection between a center shaft end and a lever arm 26. As best seen in FIGS. 5 and 6, each pivot bearing 18 includes a rectangularly shaped central opening 18*b* to receive the end of the conductive center shaft 20. The central opening 18*b* is inwardly defined by an integrally formed, square cross-sectional contact separator or spacer 30, which separator interposes between the outer periphery of each end of each center shaft 20 and the inner periphery of each blade tube 24 to peripherally space apart each shaft 20 from its associated blade 12 in an electrically insulated, operating interconnection. In this manner, rotation of a shaft 20 will cause simultaneous rotation of a blade 12, but any electrical current carried by the conductive shaft 20 will not flow to conductive portions of the affixed blade 12 due to the insulating air space 40. See FIG. 5*a*.

As is evident from the drawings, the external cross-sectional dimensions of each center shaft 20 are less than the internal cross-sectional dimensions of a blade tube 24 to permit each center shaft to be positioned within a blade tube with the insulating air space 40 therebetween. Each center shaft is maintained in a non-contacting relationship with its associated blade tube 24 by the interposed contact separators 30 of the end positioned pivot bearings 18. The electrically insulating air space 40 is maintained throughout the length of each blade tube 24 by the contact separators 30 which are endwardly positioned in both jambs 16, 17 at the end of each blade 12.

Referring again to FIG. 4, there is illustrated a portion of the circuit wiring 44, 46 of the alarm system 15. Preferably, the circuit wiring 44, 46 draws its current from a known low voltage source, such as a conventional transformer or a battery for function of an audio or visual alarm device (not shown) such as a bell, a horn, a flashing light, etc. Each of the lever arms 26 is wired in parallel through terminals 34 to transmit electrical current from the conductor 44, through each lever arm 26 to the center shaft 20 which is affixed within the lever arm opening 38. The other conductor 46 of the alarm circuit loop energizes each blade tube 24 by employing wire terminals 48 which are electrically connected to each blade tube 24 at the slot 50 through screws 52.

The construction details at each lever arm 26 may best be observed in FIG. 5 wherein the insulating and electrically conducting components are set forth. As illustrated, the optional steel bar 22 is disposed within the central cavity of a steel center shaft 20 in a manner to freely rotate if contacted by a saw. However, the bar 22 performs no electrical conducting function and is employed for structural security purposes only. The center shaft 20 extends beyond both ends of each blade tube 24 for a distance sufficient to pass through the pivot bearing 18, the non-conductive washer 54 and into the rectangular opening 38 of the lever arm 26. Each end of the center shaft is mechanically secured in an electrically conductive manner to a lever arm 26 whereby the center shaft forms a part of the alarm circuit loop represented by the conductor 44. As illustrated, each center shaft end extends through a slot 54*b* provided in a non-conductive washer 54, which washer is used to separate or space the lever arm 26 from the adjacent window jamb 16 or 17. A nylon center shaft end cap 56 serves to hold the lever arm 26 firmly in position at the end of the center shaft 20 and also prevents the steel bar 22, when present, from coming out of the core of the center shaft 20. The center shaft 20 serves as a continuation of the electrical circuit conductor 44 from the terminal 34 and through the lever arm 26.

Because, as above set forth, the louver tube 24 serves as an electrical extension of the other conductor 46 of the alarm circuit, contact between the blade tube 26 and blade center shaft 20 ordinarily must not occur. The path of electrical current to the louver blade tube must be insulated from contact with the path of current to the center shaft and this is normally accomplished by assuring the integrity of the insulating air space 40. Current flows from the terminal 48 to the louver blade tube 24 through a sheet metal screw 52. The screw 52 first passes through the metal contact strip 60 to which the terminal 48 is connected, and then passes through a nylon bushing 62 which is used to prevent the terminal 48 from coming into contact with the lever arm 26 during opening or closing of the blades 12. The screw 52 passes through a bushing **56*a* on the center shaft end cap 56, and thence through the aligned holes 54*a*, 18*a* provided in the nylon washer 54 and nylon pivot bearing 18 respectively. The separate holes 54*a*, 18*a* are spaced from the center shaft openings 54*b*, 18*b* in the adjacent washer 54 and bearing 18 to prevent contact with the center shaft 20 which passes therethrough. The screw 52 threadedly engages in the screw slot 50 which is extruded or otherwise formed on the blade tube 24 to thereby electrically connect the terminal 48 with the blade tube 24. Thus, each blade tube 24 is in electrical communication with one circuit wire or conductor 46 and each center shaft 20 is in electrical communication with the other circuit wire or conductor 44**.

As best seen in FIG. **5*a*, each center shaft 20 is suspended within the hollow interior of its associated blade tube 24 without touching any of the walls 24*a*. However, should an intruder apply force to a blade 12 that is unaccompanied by rotation of the lever arms 26, the blade tube 24 will deform into the space 40, and into contact with the center shaft 20. This contact between a deformed blade tube 24 and a center shaft 20** functions as a switch to complete the alarm circuit and to sound the alarm.

Although the present invention has been described with reference to the particular embodiments herein set forth, it is understood that the present disclosure has been made only by way of example and that numerous changes in the details of construction may be resorted to without departing from the spirit and scope of the invention. Thus, the scope of the invention should not be limited by the foregoing specification but rather only by the scope of the claims appended hereto.

What is claimed is:

1. In a jalousie type window having at least one louver blade, the combination of an electrically conductive blade tube extending at least partly along the length of a blade;

an electrically conductive shaft disposed within the blade tube, the shaft being adapted to rotate the blade between open and closed positions in response to the application of turning forces;

an electrical alarm circuit electrically connected to the jalousie type window, the circuit comprising first and second conductors;

means comprising a second terminal to electrically connect the first conductor to the blade tube;

means to electrically connect the second conductor to the shaft; and insulation means between the tube and the shaft to prevent the blade tube from contacting the electrically conductive shaft during normal use of the jalousie type window.

2. The jalousie of claim 1 wherein the blade tube is formed of aluminum.

3. The jalousie of claim 1 wherein the louver blades comprise a blade tube and a blade body, the blade tube and the blade body being integrally formed.

4. The jalousie of claim 1 wherein the window comprises a plurality of spaced, parallel louver blades, each blade including a conductive blade tube and a conductive shaft disposed within and insulated from the blade tube.

5. The jalousie of claim 4 wherein a plurality of the louver blades are each connected respectively to the second conductor and a plurality of the shafts are connected respectively to the first conductor.

6. The jalousie of claim 1 wherein said insulation means comprises insulating contact separator means disposed between the respective ends of the shaft and tube to normally prevent contact between the blade tube and the shaft.

7. The jalousie of claim 1 wherein the louver tube is sufficiently flexible so that an attempt to manually deform the louver blade will result in the deformation of the louver tube to the extent necessary to destroy the insulation means.

8. The jalousie of claim 1 and a lever arm affixed to the shaft in an electrically conductive connection, the second terminal being connected to the lever arm.

9. The jalousie of claim 8 wherein said first terminal is connected to the blade tube, the first terminal being insulated from the lever arm by an insulating channel extending from the first terminal to the blade tube.

10. The jalousie of claim 9 wherein the insulating channel comprises an insulating bushing.

11. The jalousie of claim 9 wherein the insulating channel comprises a series of bushings and washers, the bushings and washers being fabricated of of an electrically non-conductive material, the bushings and washers being installed within or adjacent to those parts of the jalousie which conduct current from the first terminal.

12. The jalousie of claim 1 wherein the shaft is hollow.

13. The jalousie of claim 12 and an elongated bar positioned within the hollow center shaft.

14. The jalousie of claim 13 wherein the elongated bar is loosely positioned within the hollow interior of the shaft whereby cutting of the shaft will be discouraged.

15. In an alarm system for use in with a jalousie window of the type comprising a plurality of pivotally movable blades, each blade being moved by an associated lever arm, and a movable operating bar connected to the lever arms to open and close the blades, the combination of alarm circuit means comprising a first conductor, a second conductor, a source of electrical power feeding current to the first and second conductors and an alarm indicating device, the first conductor energizing a first terminal, the second conductor energizing a second terminal, the first and second terminals defining an alarm circuit opening therebetween;

tube means forming a portion of each blade, at least some of the tube means being connected electrically to one of said conductors;

shaft means associated with each tube means and connected for rotation by a lever arm, at least some of the shaft means being connected electrically to the other of said conductors; and insulating means between a tube means and a shaft means to normally prevent contact therebetween to maintain the circuit opening.

16. The alarm system of claim 15 wherein the tube means comprises a tube defining a hollow interior channel and wherein the shaft means is positioned within the channel.

17. The alarm system of claim 16 wherein the channel is defined by at least one straight side.

18. The alarm system of claim 16 wherein the channel is rectangular in cross sectional configuration.

19. The alarm system of claim 15 or claim 16 wherein the insulating means comprises an air space between the tube means and the shaft means.

20. The alarm system of claim 16 wherein the insulating means comprises a peripheral air space interposed between the tube and the shaft.

21. The alarm system of claim 20 and a non-conductive spacer interposed between the outer periphery of the shaft and the inner periphery of the tube.

22. The alarm system of claim 15 wherein the shaft means is hollow.

23. The alarm system of claim 22 and a bar positioned within the hollow interior of the shaft.

24. The alarm system of claim 23 wherein the bar is not connected to either the tube or the shaft.

* * * * *